US008602080B2

(12) United States Patent
Abreu

(10) Patent No.: US 8,602,080 B2
(45) Date of Patent: Dec. 10, 2013

(54) LOUVERED PRIVACY SCREEN FOR SINGLE- AND DOUBLE-HUNG SASH WINDOWS

(76) Inventor: Odilio Abreu, Toronto (CA)

( * ) Notice: Subject to any disclaimer, the term of this patent is extended or adjusted under 35 U.S.C. 154(b) by 41 days.

(21) Appl. No.: 13/034,464

(22) Filed: Feb. 24, 2011

(65) Prior Publication Data

US 2011/0203745 A1 Aug. 25, 2011

Related U.S. Application Data

(60) Provisional application No. 61/307,701, filed on Feb. 24, 2010.

(51) Int. Cl.
*E06B 7/082* (2006.01)

(52) U.S. Cl.
USPC ..... 160/104; 52/473; 49/50

(58) Field of Classification Search
USPC ..... 160/104; 52/202, 473; 49/50, 51, 57, 49/74.1–92.1
See application file for complete search history.

(56) References Cited

U.S. PATENT DOCUMENTS 1,428,074 A * 9/1922 Brabant ..... 454/221
1,672,655 A * 6/1928 Parmenter ..... 454/221
2,210,516 A * 8/1940 Wheeler ..... 160/223
2,397,458 A * 4/1946 Allen ..... 52/473
2,466,948 A * 4/1949 Hemphill ..... 160/44
2,852,071 A * 9/1958 Smith ..... 160/104
2,877,517 A * 3/1959 Graham ..... 49/34
3,968,738 A * 7/1976 Matzke ..... 454/309
4,050,366 A * 9/1977 Wiklund et al. ..... 454/331
4,409,960 A * 10/1983 Balzer ..... 126/633
6,105,318 A * 8/2000 Harrison ..... 52/200
6,378,262 B1 * 4/2002 Mercadante ..... 52/473
7,131,241 B2 11/2006 Blackwell et al.

FOREIGN PATENT DOCUMENTS

CA 2 329 050 12/2000
WO 2008/049150 5/2008

* cited by examiner

*Primary Examiner* — David Purol
(74) *Attorney, Agent, or Firm* — Kagan Binder, PLLC

(57) ABSTRACT

An inexpensive and easy to install privacy screen for a single- or double-hung sash window. The invention comprises a plurality of horizontal louvers that are translucent and flexible, and a pair of vertical side members having a plurality of parallel slits. The louvers are affixed in parallel at both ends to the vertical side members by insertion into the slits. When installed in an open single- or double-hung sash window, the invention permits air circulation and the passage of natural light into an enclosed space, while maintaining an occupant's privacy. The invention is to be installed above or below a first sash of the window so as to allow the user to move a second sash to open and close the window with the invention in place.

5 Claims, 6 Drawing Sheets

LOUVERED PRIVACY SCREEN FOR SINGLE- AND DOUBLE-HUNG SASH WINDOWS

PRIORITY CLAIM

This application claims the benefit of U.S. Provisional Application Ser. No. 61/307,701 filed Feb. 24, 2010, entitled LOUVERED PRIVACY SCREEN FOR SINGLE- AND DOUBLE-HUNG SASH WINDOWS, the disclosure of which is incorporated herein by reference.

FIELD OF THE INVENTION

The present invention relates generally to a louvered window screen for maintaining privacy while permitting the flow of air and natural light through the window.

BACKGROUND OF THE INVENTION

Single- and double-hung sash windows are common window designs for homes and offices. Transparent glazing (such as glass or some other transparent barrier) may be used in the construction of these windows held within a frame. This transparency allows passersby to very easily see any indoor activity that takes place, creating privacy concerns for occupants. Sash windows in particular comprise two parts or sashes, each containing glazing. The sashes overlap slightly within a frame. In a hung sash window, one sash is placed above the other within the frame. In a single hung sash window, one sash moves relative to the other, while the other is fixed. In a double hung sash window, both sashes may move.

Many devices have been conceived to deflect prying eyes. Curtains, blinds, shutters, and window films all work to obstruct the line of sight of an outsider. However, these devices often require professional installation to work properly and safely, which translates to added labor cost on top of already high material costs.

Curtains, blinds, and shutters suffer an additional disadvantage, in that when they are drawn, they impair the influx of natural light and greatly reduce the air circulation of a room even when the window is open. Moreover, they can be difficult to clean in place.

Window films are also deficient because they only preserve privacy when the window is shut. Alternatively, to achieve some ventilation while maintaining privacy, occupants of an enclosed space may line the gap of an open window with objects such as potted plants. This is a flawed solution, however, as it not only still impedes the flow of fresh air into the space, but may also compromise the decor of the space.

There is therefore a need for a privacy screen for single- and double-hung sash windows that is cost-effective and easy to install and remove without sophisticated tools or acumen, and efficiently allows both the ventilation through an open window and the entry of natural light without sacrificing the privacy of the occupant.

SUMMARY OF THE INVENTION

The present invention is directed to a louvered privacy screen for use in conjunction with a window having a frame, a first sash and a second sash, comprising:

a pair of vertical side members each having a longitudinal face, each having a first slit and a second slit that are parallel to each other and oriented at about 30 degrees from vertical on each longitudinal face;

a first horizontal louver detachably affixed to the vertical side members at the ends of the first louver by insertion into the first slit;

a second horizontal louver detachably affixed to the vertical side members at the ends of the second louver parallel to the first horizontal louver by insertion into the second slits;

wherein the second louver overlaps the first louver, in that a lower edge of the first louver extends beyond a horizontal plane which meets the upper edge of the second louver;

wherein when the screen is installed in the frame above or below the first sash, the second sash is movable adjacent to the first sash without interference from the screen; and wherein the louvers are translucent and flexible.

The present invention is also directed to a method of installing the louvered privacy screen described above in a window having a frame, a first sash and a second sash, comprising the steps of:

a) sizing each of the vertical side members so that the length of each member is less than the distance between the bottom of the window frame and the bottommost face of the first sash when it is in the uppermost position within the frame;

b) placing each of the members within the jambs of the window frame adjacent to the inner surface of the jambs on either side of the frame above or below the first sash with the slits on each facing inward, and declining in the same direction relative to the frame;

c) sizing each of the louvers such that the ends of each fit within the corresponding slits on either member; and d) inserting the ends of each louver within the corresponding slits on either member.

The present invention is further directed to a kit comprising the louvered privacy screen described above and instructions for installing the louvered privacy screen described above in accordance with the method described above.

BRIEF DESCRIPTION OF THE DRAWINGS

The present invention will now be described by way of example with reference to the following drawings, in which.

DETAILED DESCRIPTION OF THE INVENTION

Figure 1:
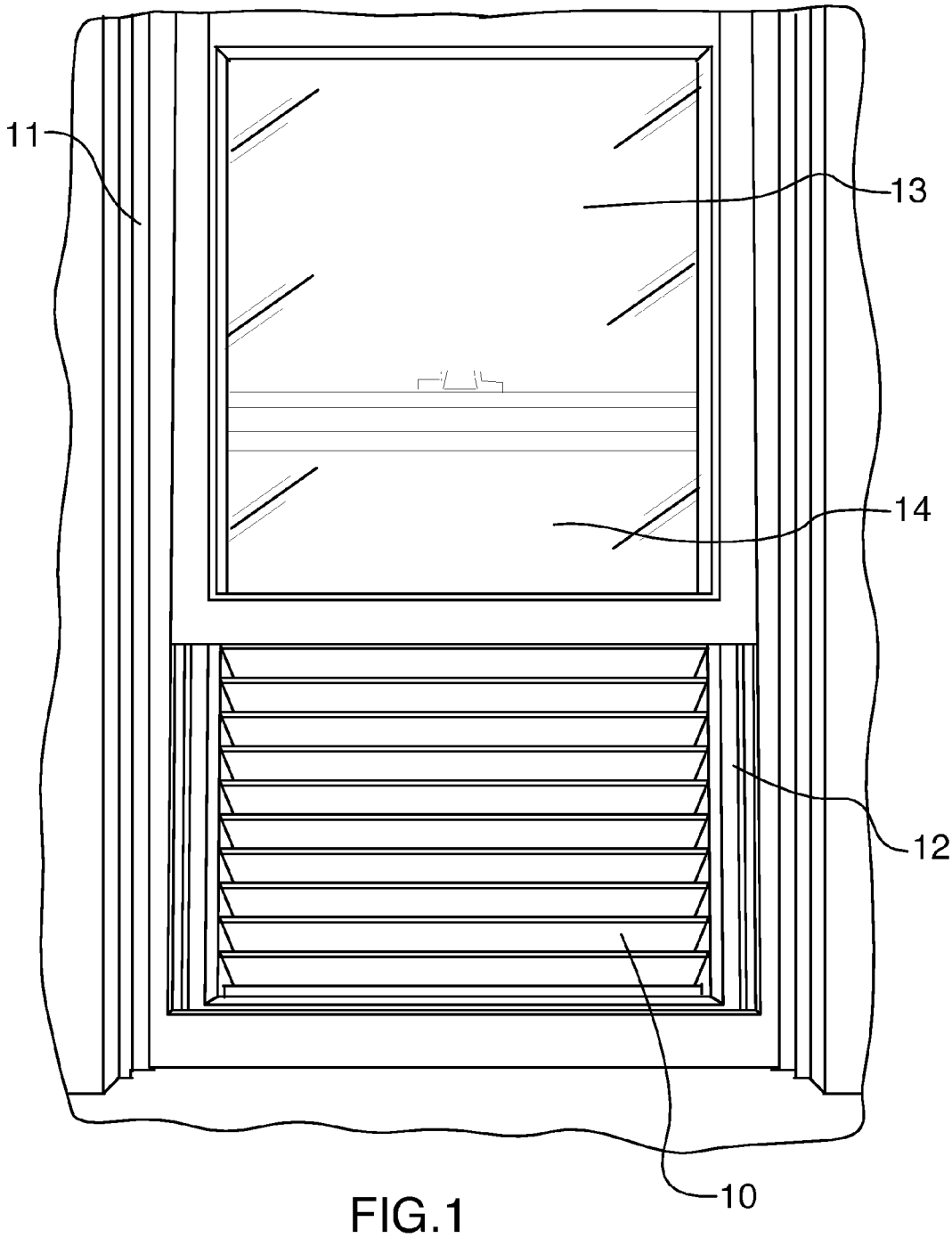
FIG. 1 is a perspective view of a first embodiment of the present invention in use, installed within an open single-hung sash window.

FIG. 1 shows a first embodiment of the present invention 10 as it is installed in a fully open single-hung sash window 11.

Figure 6:
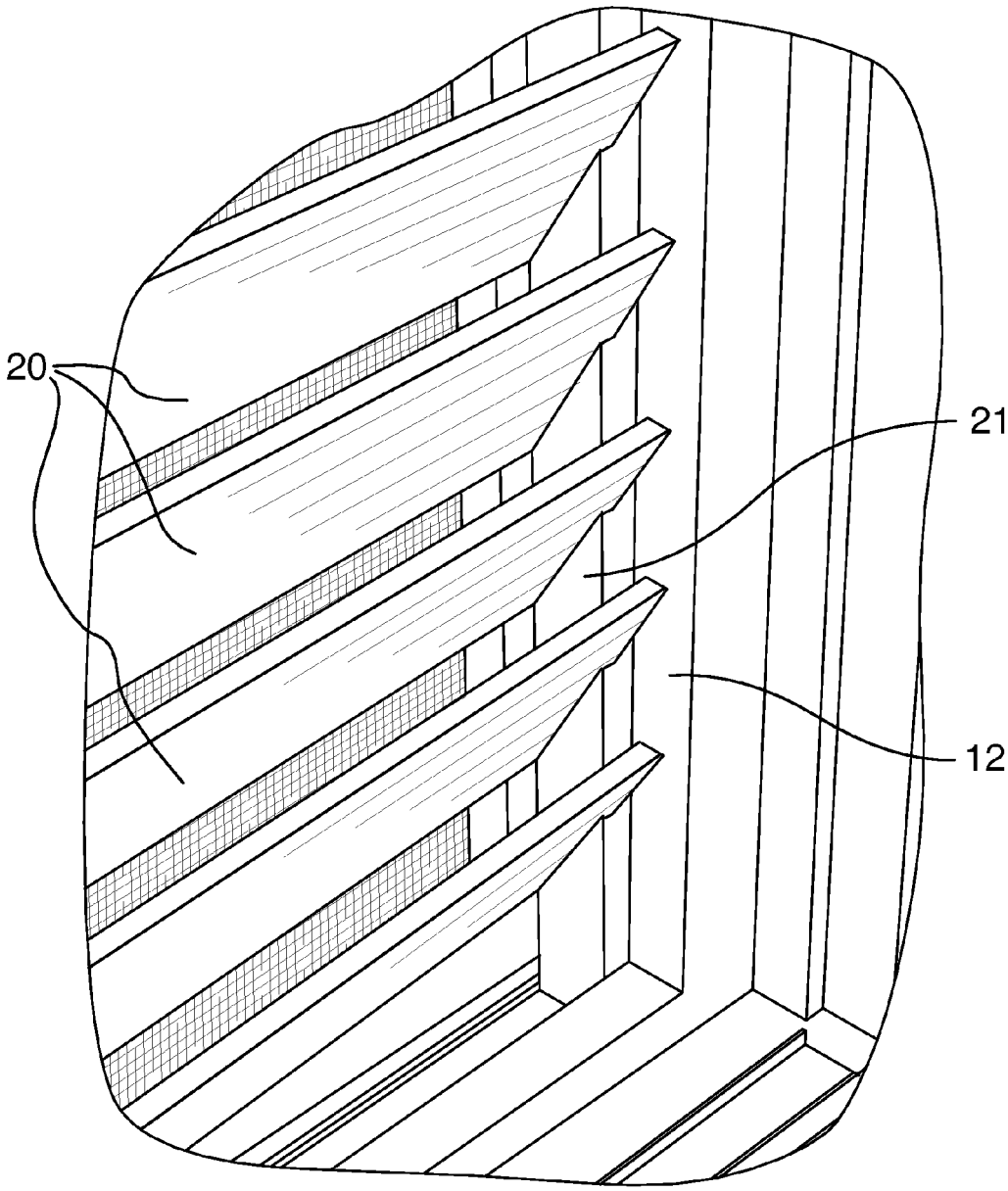
FIG. 6 is a partial view of the first embodiment of the present invention showing the positions of the components of the invention in relation to the window frame.
Figure 7:
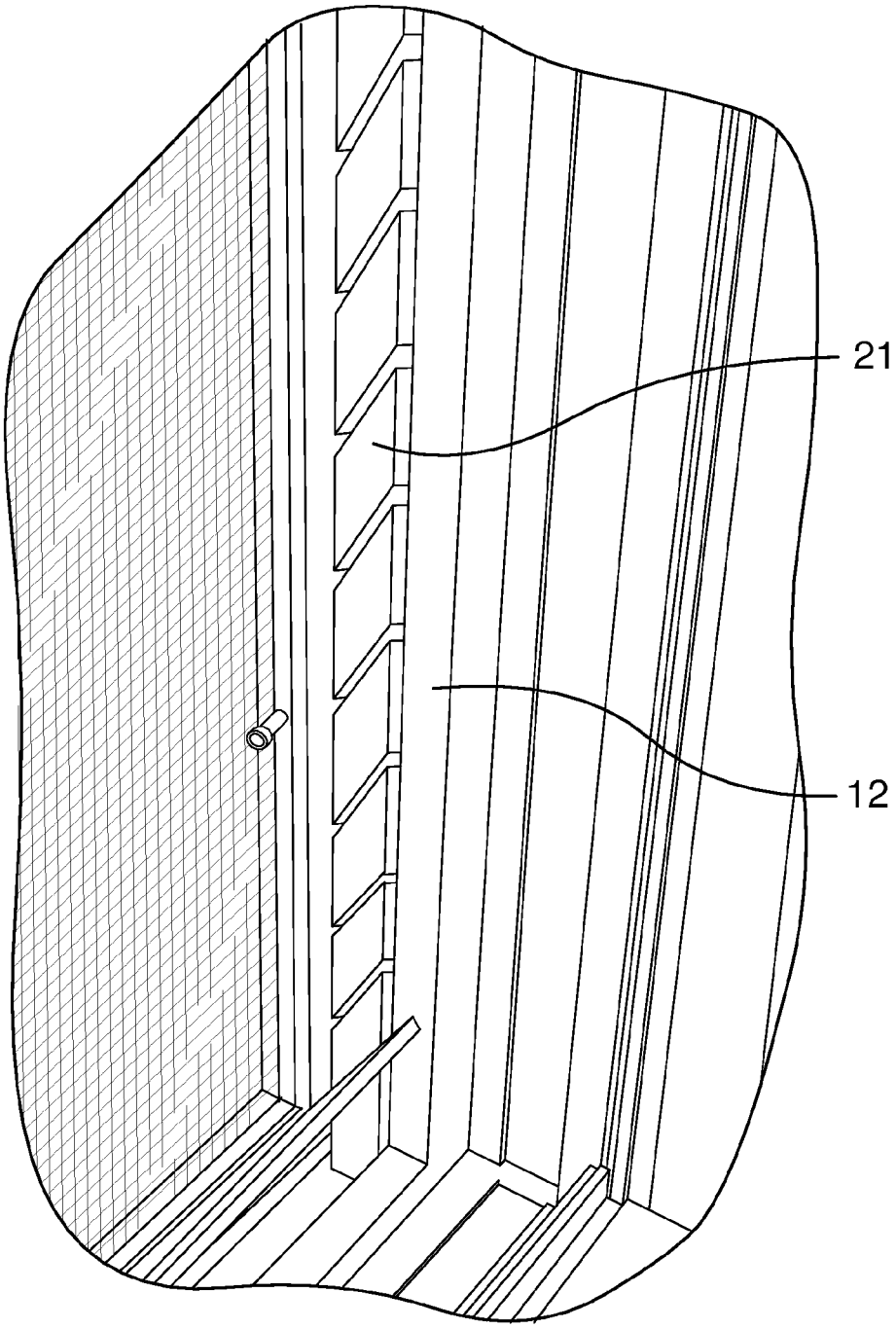
FIG. 7 is a partial view of a vertical side member showing the position of the side member in relation to the window frame.

Specifically, the present invention 10 is placed in between the jambs 12 of the window frame, directly above or below the first sash 13. The present invention 10 is equally suitable for installation in a double-hung sash window. FIG. 6 shows the positions of the components of the first embodiment in relation to the window frame; FIG. 7 shows the position of one of the vertical side members 21 of the present invention in relation to the window frame.

Figure 2:
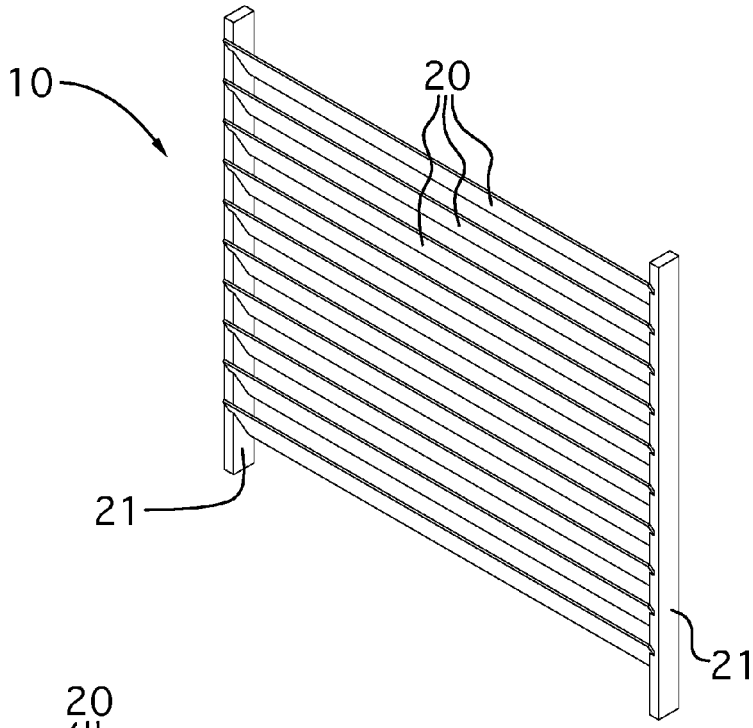
FIG. 2 is a perspective view of the first embodiment of the present invention.
Figure 3:
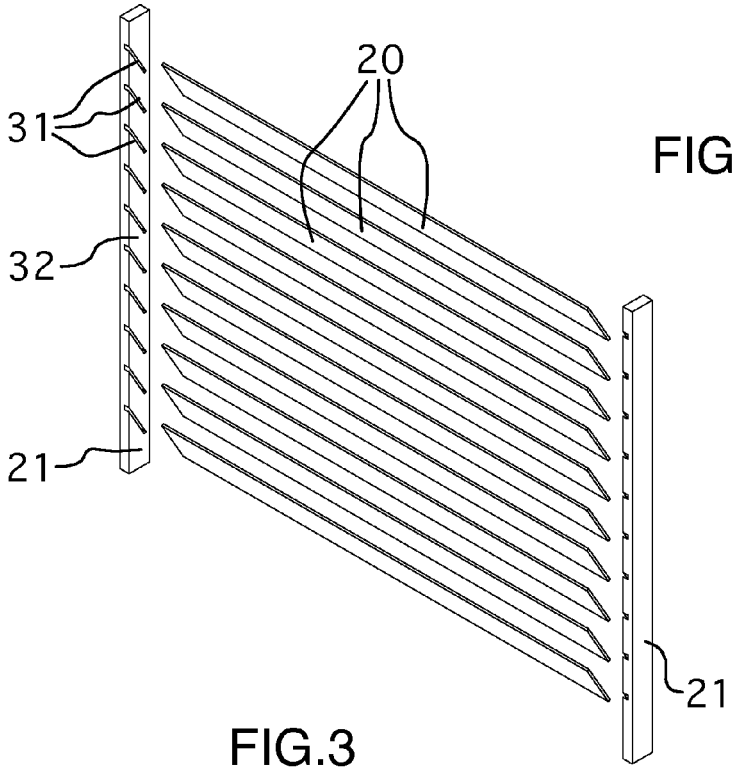
FIG. 3 is an exploded perspective view of the first embodiment of the present invention showing its components.
Figure 8:
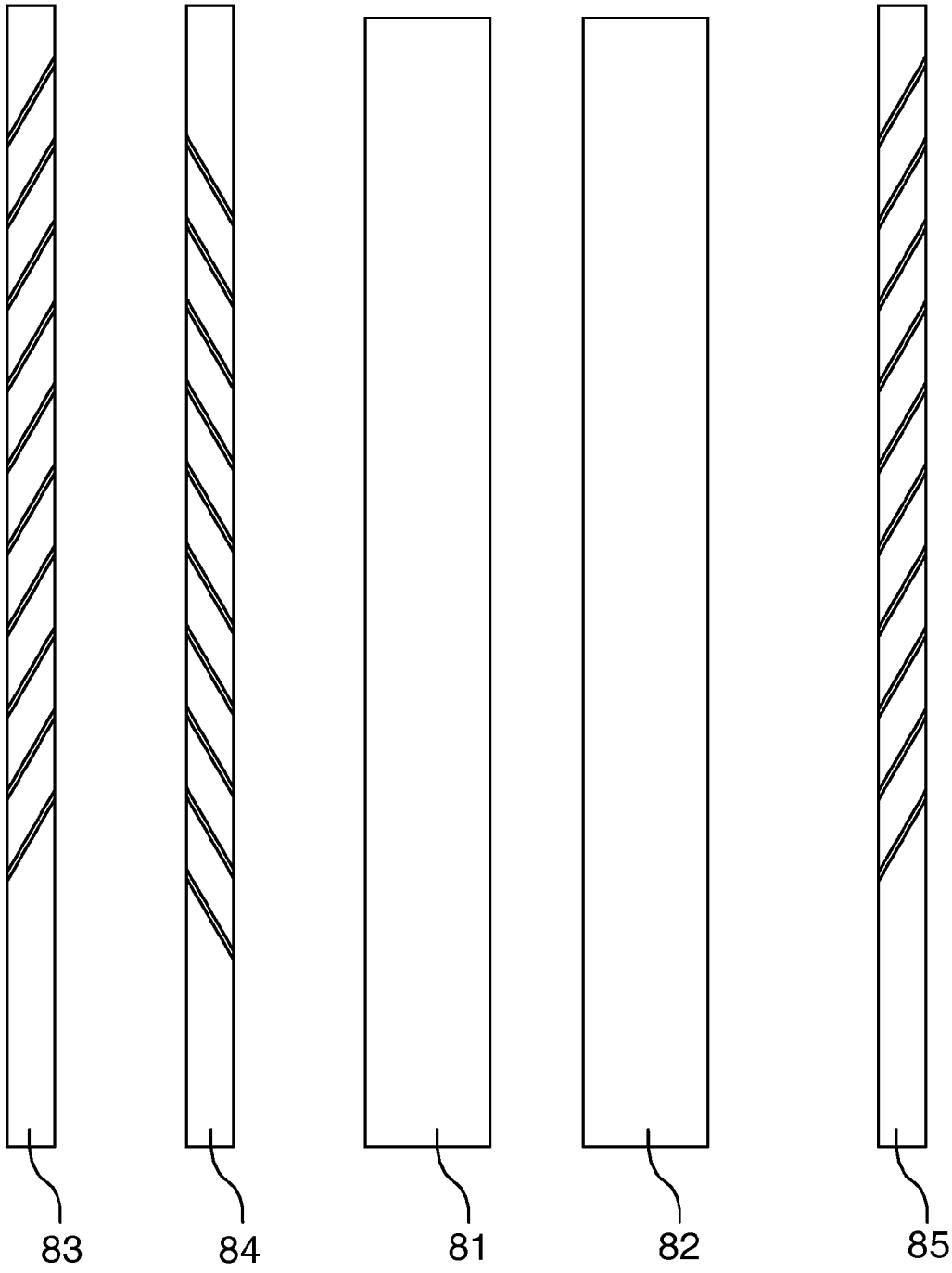
FIG. 8 is a photograph of examples of materials that may be used for constructing the components of the present invention.

FIG. 2 is a perspective view of the first embodiment of the present invention 10 standing alone. FIG. 3 shows the components of the first embodiment of the present invention in an exploded perspective view. The present invention 10 comprises a plurality of horizontal louvers 20 and a pair of vertical side members 21. The horizontal louvers 20 are made of a translucent and flexible material through which natural light can permeate but views of objects are obscured. It is preferable that the louvers 20 be made of a durable, weather-proof, and inexpensive material. In the preferred embodiment of the present invention, as shown in FIG. 8, the louvers are made of film-covered or etched plastic 81, such as frosted Plexiglas, or corrugated plastic 82. Where corrugated plastic is used, as shown in FIG. 6, the internal struts of the plastic extend lengthwise of the louver. The length of the louvers 20 may be sized by a user to fit windows of various sizes. The louvers 20 are of such a width that, when they are affixed in parallel to the vertical side members 21, they overlap to a degree that is sufficient to block a line of sight from any angle to the plane of the present invention 10 except the angle at which the horizontal louvers 20 are affixed, while permitting air flow in between the louvers. In the preferred embodiment of the present invention, the louvers 20 are three inches wide.

The two vertical side members 21 are of identical dimensions. Their length may be sized by a user to fit windows of various sizes. The depth or thickness of the side members 21 is such that they fit within the inner face of the jambs of the window frame above or below the first sash of a single- or double-hung sash window. In the preferred embodiment of the present invention, the side members are rectilinear in profile (see FIG. 8) with a square cross-section that is one inch by one inch 83 and 84 so as to fit a standard-sized window. However, the cross-section of the side members may be round 85 or rectangular. The vertical side members 21 are made of any inexpensive material that is suitable for their purpose, including recycled and eco-friendly materials. In the preferred embodiment of the present invention, as shown in FIG. 8, the side members may be constructed of aluminum 83, PVC 85, or wood 84. The vertical side members 21 may be hollow or solid.

Each vertical side member 21 has, throughout one longitudinal face 32 (hereafter referred to as the slit face) a plurality of parallel slits 31. The parallel slits 31 are of the same thickness as the horizontal louvers 20 so that the louvers can be affixed at their ends to the vertical side members 21 by insertion into the slits. The parallel slits 31 are oriented at about 30 degrees from vertical. When the respective slit faces 32 of the pair of vertical side members 21 face each other, the parallel slits on one vertical side member mirror exactly those on the other vertical side member in position and orientation. The spacing between the parallel slits 31 and the width of the horizontal louvers 20 are predetermined and prefabricated so that, when the louvers are affixed to the vertical side members 21, they overlap to a degree that is sufficient to block a line of sight from any angle to the plane of the present invention 10 except the angle at which the horizontal louvers 20 are affixed. In the preferred embodiment of the present invention, the parallel slits are spaced at 1⅝ inch apart.

Figure 4A:
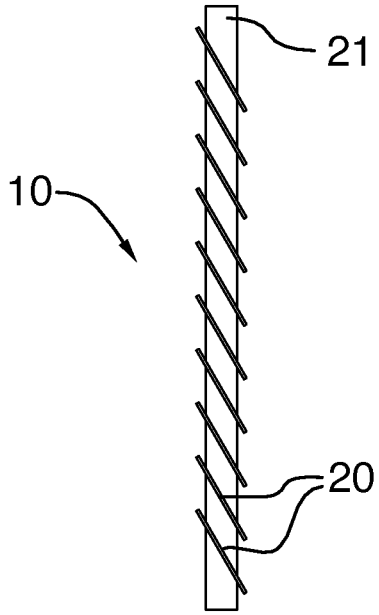
FIG. 4*a* is a cross-sectional side view of the first embodiment of the present invention.
Figure 4B:
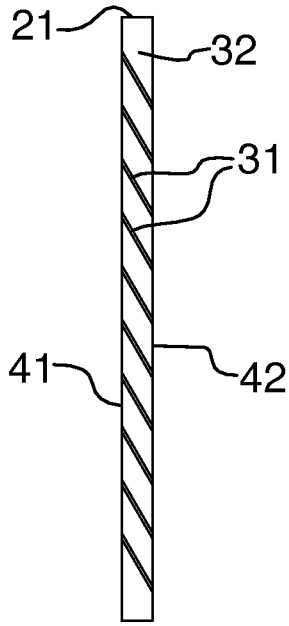
FIG. 4*b* is a slit face view of a vertical side member of the first embodiment of the present invention.
Figure 5A:
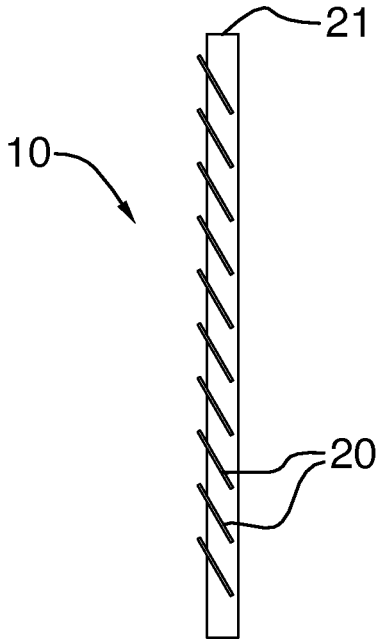
FIG. 5*a* is a cross-sectional side view of a second embodiment of the present invention.
Figure 5B:
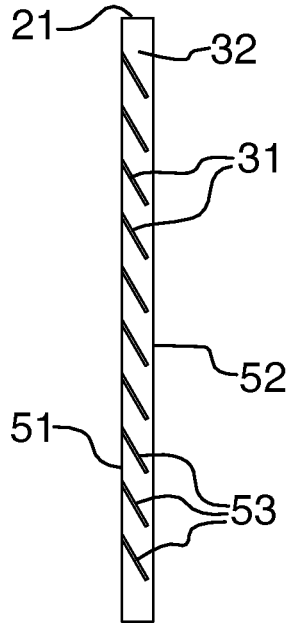
FIG. 5*b* is a slit face view of a vertical side member of the second embodiment of the present invention.

The present invention 10 may be installed in single- and double-hung windows as follows. In a single-hung sash window (e.g., FIG. 1), a user moves a second sash 14 along a guide track to open and close the window. In a double-hung sash window, a user may move both a first sash and a second sash along their respective guide tracks to open and close the window. Referring to FIG. 1, the present invention 10 is installed in a single-hung sash window by first placing each vertical side member 21 adjacent to the inner face of each jamb 12 on either side of the window frame, above or below the first sash 13. This step does not cause any damage to the jambs, as the side members do not need to be held in place by glue, nails, or other known methods of attachment. The slit faces 32 of the vertical side members 21 face inward at each other, and the parallel slits 31 decline in the same direction relative to the frame. Referring to FIGS. 4*b* and 5*b*, which show the slit face 32 of a vertical side member 21 of two different embodiments of the present invention, this placement of the side members distinguishes the side members as having an inner face 41 & 51 (which faces the enclosed space) and an outer face 42 & 52 (which faces the exterior).

Similarly, the present invention 10 is installed in a double-hung sash window by first placing each vertical side member 21 adjacent to the inner face of the jambs of the window frame, above or below the first sash. Again, this step does not cause any damage to the jambs. The slit faces 32 of the vertical side members 21 face inward at each other, and the parallel slits 31 decline in the same direction relative to the frame.

Thereafter, the horizontal louvers 20 are inserted into the parallel slits 31 of the vertical side members 21 so as to extend horizontally and in parallel between the side members. The horizontal louvers 20 are thereby detachably affixed to the vertical side members 21, allowing the user to easily clean the screen by removing the louvers one at a time without disassembling the present invention.

The present invention can be sized to fit above or below the first sash of single- and double-hung sash windows within the jambs of the window frame, thereby allowing the user to move the second sash to open and close the window without needing to remove the present invention.

The parallel slits 31 may hold the horizontal louvers 20 in one of two ways. As mentioned above, the parallel slits 31 are of the same thickness as the horizontal louvers 20. In a first embodiment of the present invention (see FIG. 4*b*), the parallel slits 31 on the slit face 32 of a vertical side member 21 extend from the inner face 41 to the outer face 42 of the side member. In this embodiment, the horizontal louvers 20 are detachably affixed to the vertical side members 21 by friction between the ends of the louvers and the parallel slits 31. FIG. 4*a* shows the cross-sectional side view of this first embodiment of the present invention.

In a second embodiment of the present invention (see FIG. 5*b*), the parallel slits 31 on the slit face 32 of a vertical side member 21 extend from the inner face 51 to near (but not beyond) the outer face 52 of the side member, creating a stop 53 in each parallel slit near the outer face 52 of the side members. In this embodiment, the horizontal louvers 20 are detachably affixed to the vertical side members 21 by the stops 53 of the parallel slits 31. FIG. 5*a* shows the cross-sectional side view of this second embodiment of the present invention.

As evident from the above description, the present invention offers great advantages of reduced material cost and simplicity in installation and maintenance (which also translates to a reduction in cost). The present invention also enables the user to ventilate an enclosed space through an open single- or double-hung sash window and enjoy the natural light passing into the space while preserving privacy.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents are intended to fall within the scope of the claims.

What is claimed is:

1. A louvered privacy screen for use in conjunction with a window having a frame, a first sash and a second sash, comprising:

a. a pair of vertical side members each having a thickness and inner, outer, and longitudinal faces, each having a first slit and a second slit that are parallel to each other and oriented at about 30 degrees from vertical on each longitudinal face so that a portion of each slit near the inner face is higher than a portion of each slit near the outer face;

b. a first horizontal louver, comprising upper and lower edges, detachably affixed to the vertical side members at the ends of the first louver by insertion into the first slit of each side member;

c. a second horizontal louver detachably affixed to the vertical side members at the ends of the second louver parallel to the first horizontal louver by insertion into the second slit of each side member;

wherein the upper edge of the first louver is above the upper edge of the second louver, and the second louver overlaps the first louver, in that the lower edge of the first louver extends below a horizontal plane which meets the upper edge of the second louver;

wherein the slits extend from the inner faces of the side members downward to near the outer faces of the side members without obstruction at the inner face so that a user can remove each louver by pulling the louver, without the use of any tools;

wherein when the screen is installed in the frame above or below the first sash, the second sash is movable adjacent to the first sash without interference from the screen;

wherein the thickness of each side member is sized so that the side member fits within a jamb of the window frame, the jamb having an inner face, so that the side member is adjacent to the inner face of the jamb and thereby is retained within the jamb when the louvers are affixed to the side members, and the side members are not held in place by glue, nails, or screws; and wherein the louvers are translucent and flexible.

2. The screen according to claim 1, wherein the first and second slits extend from the inner face of the vertical side member to the outer face of the vertical side member.

3. The screen according to claim 1, wherein the first and second slits extend from the inner face of the vertical side member to a line proximate to but not beyond the outer face of the vertical side member.

4. A method of installing the louvered privacy screen of claim 1 in a window having a frame, a first sash and a second sash, comprising the steps of:

a. sizing each of the vertical side members so that the length of each member is less than the distance between the bottom of the window frame and the bottommost face of the first sash when it is in the uppermost position within the frame;

b. placing each of the members within the jambs of the window frame adjacent to the inner surface of the jambs on either side of the frame below or above the first sash with the slits on each facing inward, and declining in the same direction relative to the frame;

c. sizing each of the louvers such that the ends of each fit within the corresponding slits on either member; and d. inserting the ends of each louver within the corresponding slits on either member.

5. A kit comprising a louvered privacy screen for use in conjunction with a window having a frame, a first sash and a second sash, comprising:

a. a pair of vertical side members each having a thickness and inner, outer and longitudinal faces, each side member having a first slit and a second slit that are parallel to each other and oriented at about 30 degrees from vertical on each longitudinal face so that a portion of each slit near the inner face is higher than a portion of each slit near the outer face;

b. a first horizontal louver having upper and lower edges, the first louver being detachably affixable to the vertical side members at the ends of the first louver by insertion into the first slit of each side member;

c. a second horizontal louver having upper and lower edges, the second louver being detachably affixable to the vertical side members at the ends of the second louver parallel to the first horizontal louver by insertion into the second slit of each side member; and d. instructions for installing the side members adjacent to the inner face of each jamb of the window frame, and affixing the louvers to the side members;

wherein, after installation, the upper edge of the first louver is above the upper edge of the second louver, and the second louver overlaps the first louver, in that the lower edge of the first louver extends below a horizontal plane which meets the upper edge of the second louver, wherein the slits extend from the inner faces of the side members downward to near the outer faces of the side members without obstruction at the inner face so that a user can remove each louver by pulling the louver, without the use of any tools;

wherein when the screen is installed in the frame above or below the first sash, the second sash is movable adjacent to the first sash without interference from the screen;

wherein the thickness of each side member is sized so that the side member fits within a jamb of the window frame, the jamb having an inner face, so that the side member is adjacent to the inner face of the jamb and thereby is retained within the jamb when the louvers are affixed to the side members, and the side members are not held in place by glue, nails, or screws; and wherein the louvers are translucent and flexible.

* * * * *